US008292361B2

(12) United States Patent
Chen

(10) Patent No.: US 8,292,361 B2
(45) Date of Patent: Oct. 23, 2012

(54) COLLAPSIBLE CHAIR

(76) Inventor: Libin Chen, Changzhou (CN)

( * ) Notice: Subject to any disclaimer, the term of this patent is extended or adjusted under 35 U.S.C. 154(b) by 281 days.

(21) Appl. No.: 12/684,949

(22) Filed: Jan. 10, 2010

(65) Prior Publication Data

US 2011/0169304 A1 Jul. 14, 2011

(51) Int. Cl.
*A47C 4/28* (2006.01)

(52) U.S. Cl. ..... 297/42; 297/44

(58) Field of Classification Search ..... 297/16.1, 297/35, 42, 44, 45; 248/118, 164
See application file for complete search history.

(56) References Cited

U.S. PATENT DOCUMENTS

| | | | | |
|---|---|---|---|---|
| 6,572,133 | B1 * | 6/2003 | Stevens | 280/642 |
| 7,918,495 | B2 * | 4/2011 | Chen | 297/42 |
| 2003/0025362 | A1 * | 2/2003 | Liu | 297/45 |
| 2010/0013276 | A1 * | 1/2010 | Tholkes et al. | 297/174 R |

* cited by examiner

*Primary Examiner* — Sarah B McPartlin

(57) ABSTRACT

A collapsible chair has a frame and a cover attaching thereto. The frame has a left side stand and an identical right side stands, which linked by four pairs of scissoring linking bars. A hook frame and a pillar frame are provided pivotally linked to the frame. The pillar frame has side pillars securely formed thereon and the hook frame has hooks defined in an end thereof. The hooks and the pillars are able to engage when the collapsible chair is fully expanded, which makes the collapsible chair self-stable and much safer: a loose or broken soft cover or attachment thereof to the frame will not cause breakdown of the whole frame which may serious injure the user.

2 Claims, 5 Drawing Sheets

COLLAPSIBLE CHAIR

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a collapsible chair, and more particularly, to a collapsible chair the frame of which is self-stable, meaning that it itself has an ultimate position of expanding without aid of the soft cover attaching thereon.

2. Description of Related Art

Conventional collapsible chairs always have a limit expanding position depends on a sustaining force from one or more soft covers attaching to frames thereof. This kind of collapsible chairs has some drawbacks. Firstly, once the soft covers pulling the collapsible frame become loose or broken, the whole structure of the collapsible chair might deform or even disintegrate. This may bring much danger to a user sitting on. Secondly, for such conventional collapsible chairs, in order to make the chair safer, the soft covers have to be strong and tough enough. This will increase a cost of both material and manufacturing.

BRIEF SUMMARY OF THE INVENTION

The main object of the invention is to provide a self-stable frame will be much safer: a loose or broken soft cover or attachment thereof to the frame will not cause breakdown of the whole frame which may serious injure the user.

Another object of the invention is to provide a self-stable collapsible chair the strength and toughness of the soft cover of which will be much lowered, which means a reduced producing cost.

In order to accomplish aforementioned objects, the invention provides a collapsible chair having a frame having a left side stand and an identical right side stands, each side stand having a level ground bar, an upright front leg, and an upright rear leg; a left front, a left rear, a right front, and a right rear connecters respectively and securely fixed to a top of the left front, left rear, right front, and right rear legs; a left attaching bar being securely fixed to the left front and the left rear connectors, and a right attaching bar being securely fixed to the right front and the right rear connectors; a left front, a left rear, a right front, and a right rear sleeves respectively and slidably covering on the left front, left rear, right front, and right rear legs; a left front, a left rear, a right front, and a right rear upper linking bars each having an upper end pivotally linked respectively to the left front, left rear, right front, and right rear connecters; a left front, a left rear, a right front, and a right rear lower linking bars each having an lower end pivotally linked respectively to the left front, left rear, right front, and right rear sleeves; the left front upper and lower linking bars, the left rear upper and lower linking bars, the right front upper and lower linking bars, the right rear upper and lower linking bars being respectively hinged together around a left front, a left rear, a right front, and a right rear pins at roughly a middle portion respectively thereof and able to rotate with each other; free ends of the left front and the right front upper linking bars, free ends of the left rear and the right rear upper linking bars, free ends of the left front and the right front lower linking bars, free ends of the left rear and the right rear lower linking bars being respectively linked together and able to rotate with each other; a hook frame having a right handle bar and a pair of identical protruding right arms, the protruding right arms being respectively and pivotally linked to the right front and the right rear pins; and, a pillar frame having a left handle bar and a pair of identical protruding left arms, the protruding left arms being respectively and pivotally linked to the left front and the left rear pins; each the left arms having a side pillar securely formed thereon and each the right arms having a hook defined in an end thereof; and, a soft cover attached on the left and the right attaching bars.

These and other objectives, features, and advantages of the present invention will become apparent from the following detailed description, the accompanying drawings, and the appended claims.

DETAILED DESCRIPTION OF THE INVENTION

Figure 1:
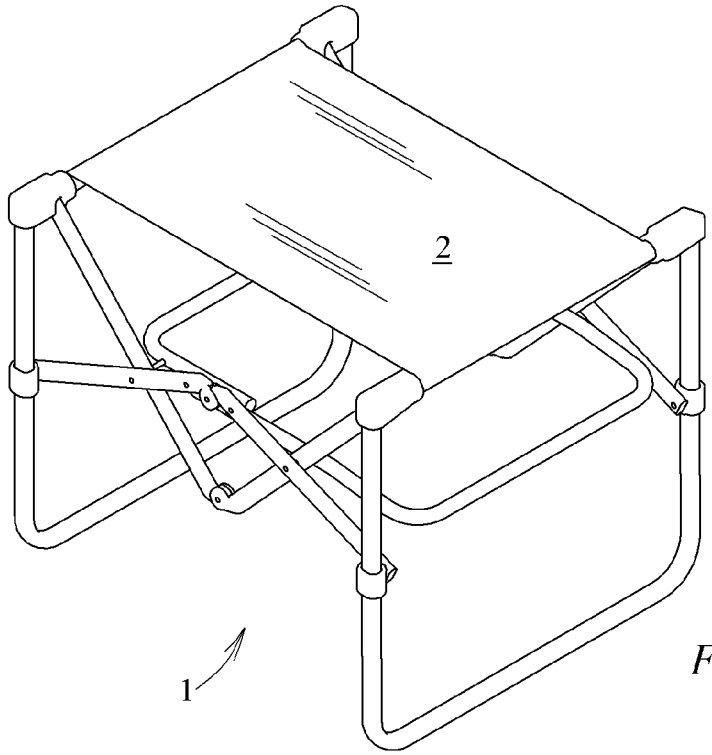
FIG. 1 is a schematic perspective view showing the preferred embodiment of the collapsible chair of the invention.

Shown in FIG. 1 is the preferred embodiment of the collapsible chair. The collapsible chair has a frame 1 and a soft cover 2 attached on the frame 1. The frame 1 and the soft cover attaching thereon are in an fully expanded position.

Figure 2:
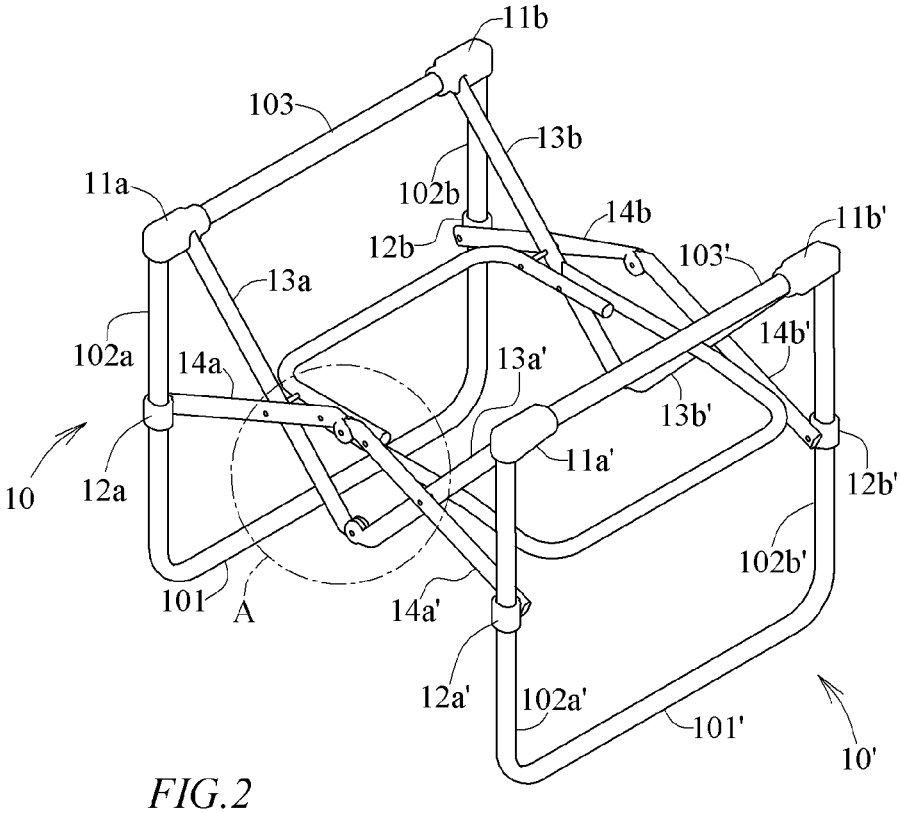
FIG. 2 is a schematic perspective view showing a frame of the collapsible chair shown in FIG. 1 without a cover.
Figure 3:
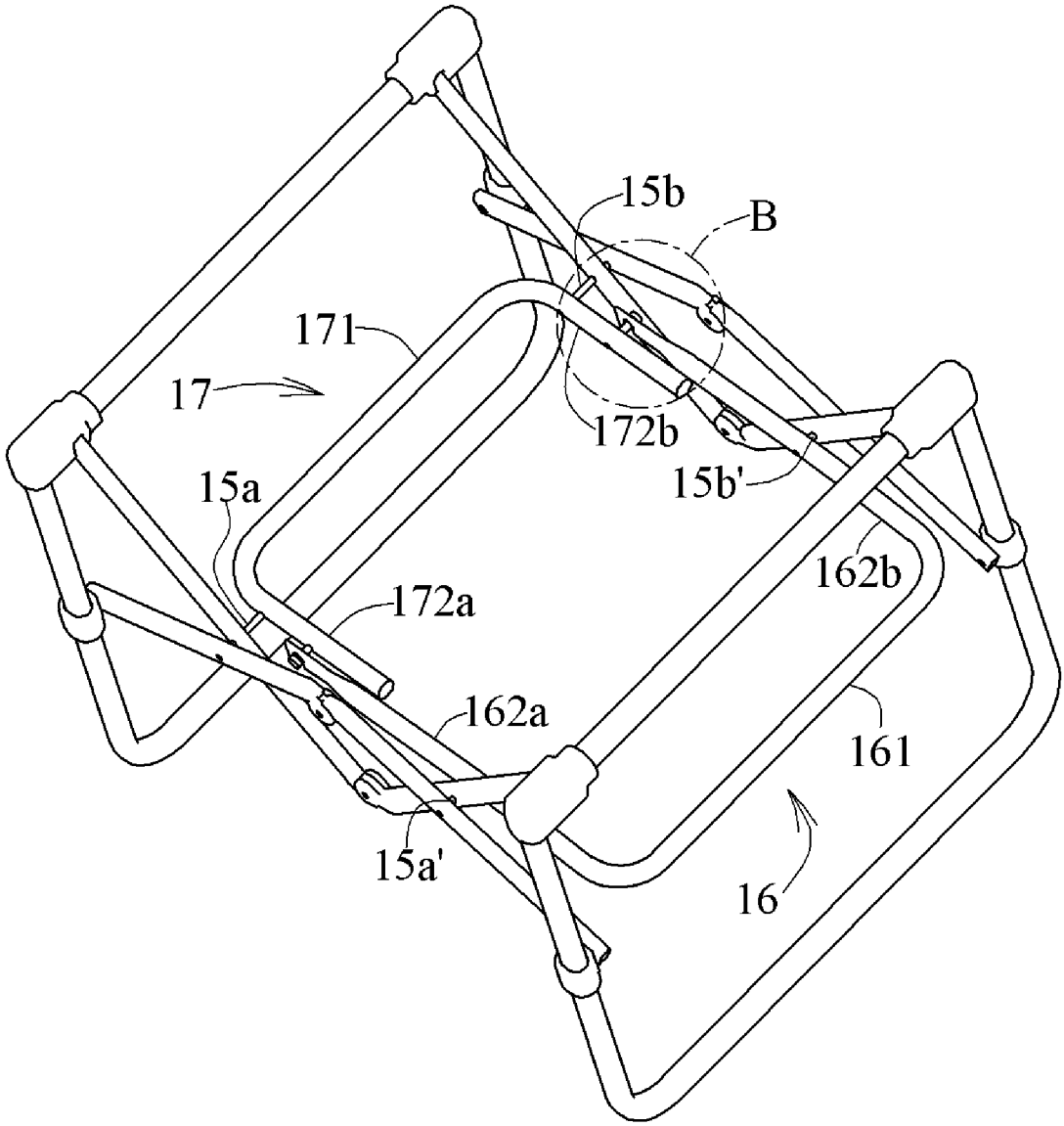
FIG. 3 is another schematic perspective view showing the frame shown in FIG. 2.
Figure 4:
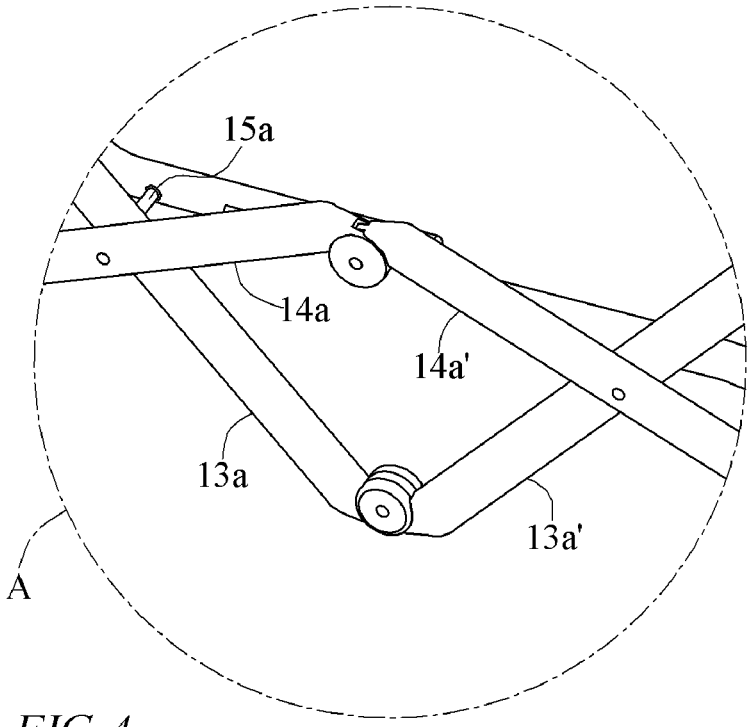
FIG. 4 is a partially enlarged view showing portion A of FIG. 2.

With reference to FIGS. 2, 3 and 4, in which the soft cover 2 is removed, the frame 1 has a left side stand 10 and an identical right side stands 10' both of U-shape. Each side stand 10/10' has a level ground bar 101/101', an upright front leg 102*a*/102*a*', and an upright rear leg 102*b*/102*b*'. A left front, a left rear, a right front, and a right rear connecters 11*a*, 11*b*, 11*a*', 11*b*' are respectively and securely fixed to a top of the left front, the left rear, the right front, and the right rear legs 102*a*, 102*b*, 102*a*', 102*b*'. A left attaching bar 103 is securely fixed to the left front and the left rear connectors 11*a* and 11*b*, and a right attaching bar 103' is securely fixed to the right front and the right rear connectors 11*a*' and 11*b*'. A left front, a left rear, a right front, and a right rear sleeves 12*a*, 12*b*, 12*a*', 12*b*' are respectively and slidably covering on the left front, the left rear, the right front, and the right rear legs 102*a*, 102*b*, 102*a*', 102*b*'. A left front, a left rear, a right front, and a right rear upper linking bars 13*a*, 13*b*, 13*a*', 13*b*' each has an upper end pivotally linked respectively to the left front, the left rear, the right front, and the right rear connecters 11*a*, 11*b*, 11*a*', 11*b*'. A left front, a left rear, a right front, and a right rear lower linking bars 14*a*, 14*b*, 14*a*', 14*b*' each has an lower end pivotally linked respectively to the left front, the left rear, the right front, and the right rear sleeves 12*a*, 12*b*, 12*a*', 12*b*'. The left front upper and lower linking bars 13*a* and 14*a*, the left rear upper and lower linking bars 13*b* and 14*b*, the right front upper and lower linking bars 13*a*' and 14*a*', the right rear upper and lower linking bars 13*b*' and 14*b*' are respectively hinged together around a left front, a left rear, a right front, and a right rear pins 15*a*, 15*b*, 15*a*', and 15*b*' at roughly a middle portion respectively thereof and able to rotate with each other. Free ends of the left front and the right front upper linking bars 13*a* and 13*a*', free ends of the left rear and the right rear upper linking bars 13*b* and 13*b*', free ends of the left front and the right front lower linking bars 14*a* and 14*a*', free ends of the left rear and the right rear lower linking bars 14*b* and 14*b*', are respectively linked together and able to rotate with each other. The soft cover 2 is attached to the left and the right attaching bars 103 and 103'.

Figure 5:
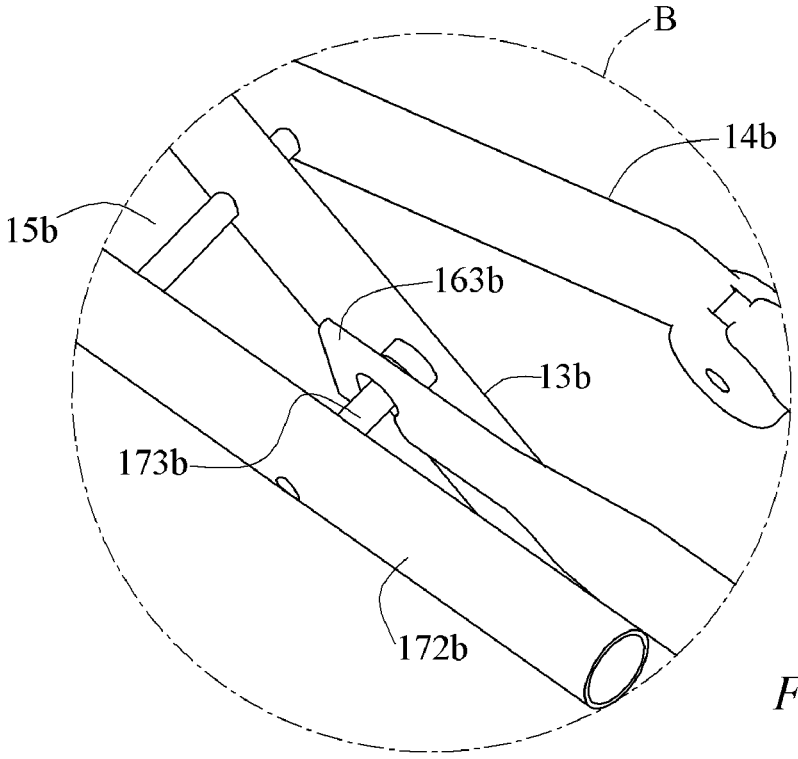
FIG. 5 is a partially enlarged view showing portion B of FIG. 3.

The frame 1 further has a hook frame 16 and a pillar frame 17 both of U-shape. The hook frame 16 has a right handle bar 161 and a pair of identical protruding right arms 162*a*, 162*b*. The protruding right arms 162*a*, 162*b* are respectively and pivotally linked to the right front and the right rear pins 15*a*' and 15*b*'. The pillar frame 17 has a left handle bar 171 and a pair of identical protruding left arms 172*a*, 172*b*. The protruding left arms 172*a*, 172*b* are respectively and pivotally linked to the left front and the left rear pins 15*a* and 15*b*. Together with reference to FIG. 5, each left arms 172*a*, 172*b* has a side pillar 173*a*, 173*b* securely formed thereon and each right arms 162*a*, 162*b* has a hook 163*a*, 163*b* defined in an end thereof. When the frame 1 is fully expanded, each couple of hook 163*a*/163*b* and side pillar 173*a*/173*b* is able to firmly engage, as especially shown in FIG. 5. At this position, the side stands 10, 10', the linking bars 13*a*, 13*b*, 13*a*', 13*b*', 14*a*, 14*b*, 14*a*', 14*b*', the hook frame 16, and the pillar frame 17 are locked and not able to move with respect to one another.

According to above description, it could be seen that at an ultimately expanded position of the collapsible chair, the frame 1 is self-stable and requires no pulling force from the soft cover attaching thereon. This means that a loose or broken soft cover will no longer cause breakdown of the whole frame 1 which may serious injure the user. And as another result, strength and toughness of the soft cover 2 will be able to be much lowered, which means a reduced producing cost.

Figure 6:
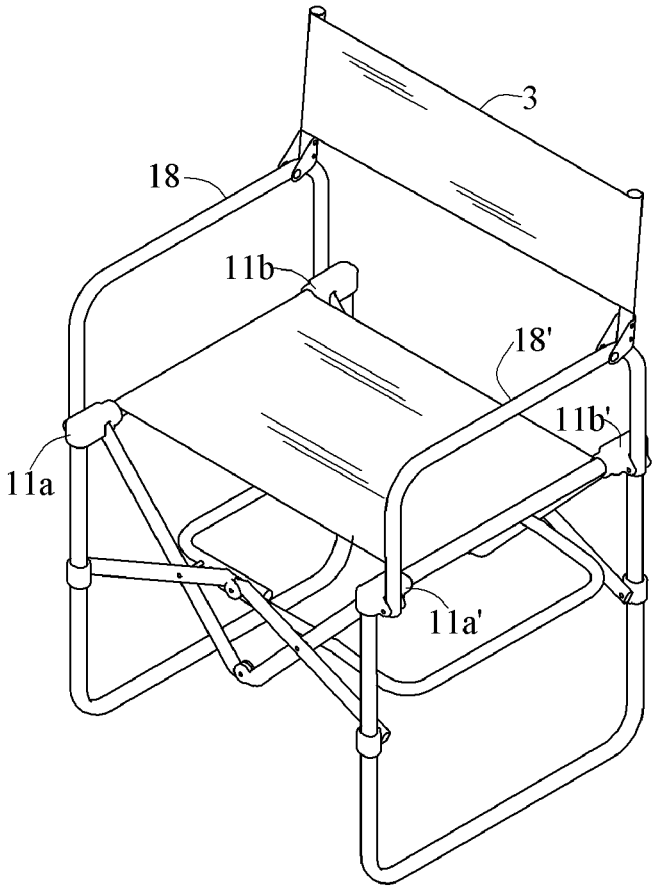
FIG. 6 is a schematic perspective view showing another embodiment of the collapsible chair of the invention.
Figure 7:
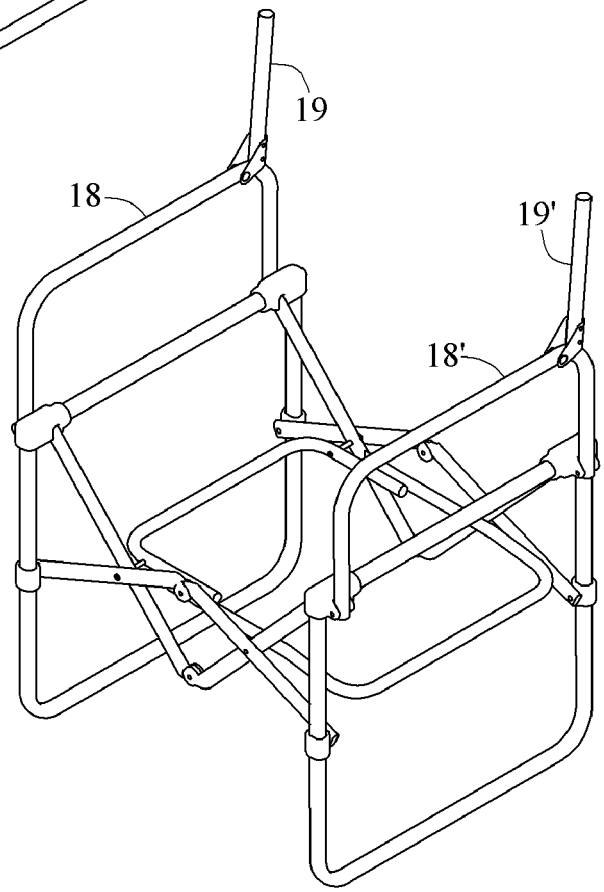
FIG. 7 is a schematic perspective view showing a frame of the collapsible chair shown in FIG. 7 without a cover. And, FIG. 8*a* through 8*d* are perspective views showing an operation of folding and expanding of the collapsible chair shown in FIGS. 6 and 7.

Shown in FIGS. 6 and 7 is another embodiment of the collapsible chair and the bare frame thereof. The difference between this and the preferred embodiment is that the collapsible chair further has a pair of U-shaped identical arm rests 18, 18' pivotally linked to the left front and the left rear connectors 11*a* and 11*b*, and the right front and the right rear connecters 11*a*', 11*b*', respectively, a pair of identical back frames 19, 19' each pivotally linked to one of the arm rests 18, 18', and a back soft cover 3 attaching on the back frames 19, 19'.

Figure 8A:
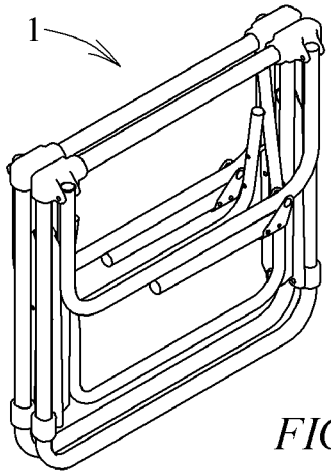
Figure 8B:
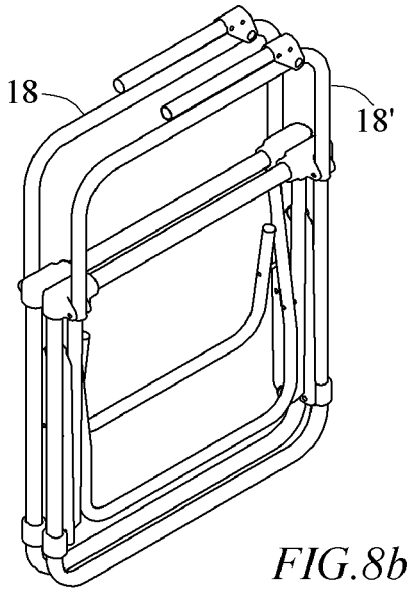
Figure 8C:
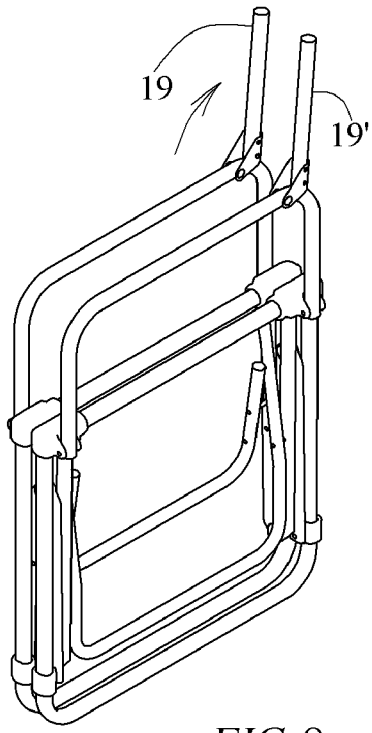
Figure 8D:
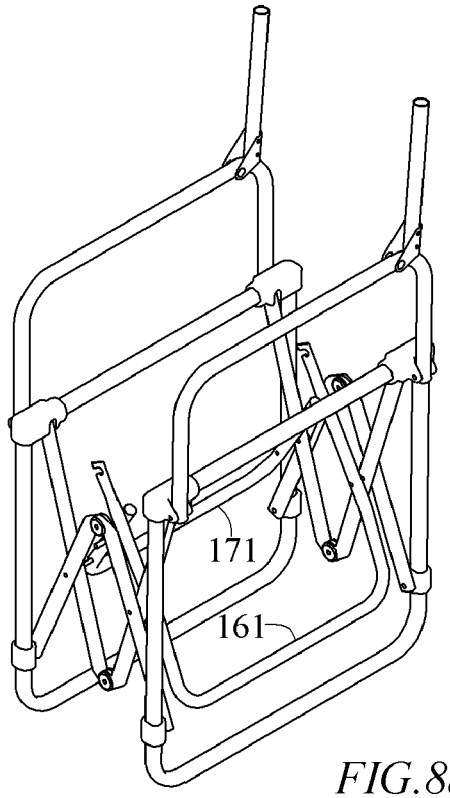

FIGS. 8*a* through 8*d* are perspective views showing an operation of folding and expanding of the collapsible chair shown in FIGS. 6 and 7. For better understanding of the movement of the frame 1, the soft covers 2 and 3, which effects the operation of folding and expanding slightly, are removed from the FIGs. FIG. 8*a* shows a status when the collapsible chair is completely folded. A user is able to pull the U-shaped arm rests 18, 18' outward with his two hands until they reach an upright position as shown in FIG. 8*b*. Then he is able to rotate the back frames 19, 19' upward as shown in FIG. 8*c*. As shown in FIG. 8*d*, the user will be able to pull the left and the right handle bars 171 and 161 with his two hands outward until each couple of hook 163*a*/163*b* and side pillar 173*a*/173*b* firmly engage, as especially shown in FIGS. 6 and 7, the collapsible chair of the invention is fully expanded. A reverse operation will be able to fold the collapsible chair. The preferred embodiment shown in FIGS. 1 and 2 is able to be similarly folded and expended, only without operations on the arm rests 18, 18' and the back frames 19, 19'.

From above description, it is seen that the objects of the present invention have been fully and effectively accomplished. Embodiment of the invention has been shown and described for the purposes of illustrating the functional and structural principles of the present invention and is subject to change without departure from the invention's principles. Therefore, this invention includes all modifications encompassed within the spirit and scope of the following claims.

The invention claimed is:

1. A collapsible chair comprising:

a frame having a left side stand and an identical right side stand, each said side stand having a level ground bar, an upright front leg, and an upright rear leg; a left front, a left rear, a right front, and a right rear connecter securely fixed to a top of said left upright front, left upright rear, right upright front, and right upright rear legs respectively; a left attaching bar being securely fixed to said left front and said left rear connectors, and a right attaching bar being securely fixed to said right front and said right rear connectors; a left front, a left rear, a right front, and a right rear sleeve slidably covering on said left upright front, left upright rear, right upright front, and right upright rear legs respectively; a left front, a left rear, a right front, and a right rear upper linking bar each having an upper end pivotally linked to said left front, left rear, right front, and right rear connecters respectively; a left front, a left rear, a right front, and a right rear lower linking bar each having a lower end pivotally linked to said left front, left rear, right front, and right rear sleeves respectively; said left front upper and lower linking bars, said left rear upper and lower linking bars, said right front upper and lower linking bars, said right rear upper and lower linking bars being hinged together around a left front, a left rear, a right front, and a right rear pin respectively at roughly a middle portion of said respective linking bars, said linking bars able to rotate with each other; free ends of said left front and said right front upper linking bars, free ends of said left rear and said right rear upper linking bars, free ends of said left front and said right front lower linking bars, free ends of said left rear and said right rear lower linking bars being respectively linked together and able to rotate with each other; a hook frame having a right handle bar and a pair of identical protruding right arms, said protruding right arms being respectively and pivotally linked to said right front and said right rear pins; and, a pillar frame having a left handle bar and a pair of identical protruding left arms, said protruding left arms being respectively and pivotally linked to said left front and said left rear pins; each said left arms having a side pillar securely formed thereon and each said right arms having a hook defined in an end thereof; and, a soft cover attached to said left and said right attaching bars.

2. The collapsible chair as claimed in claim 1 wherein said collapsible chair further has a pair of identical arm rests pivotally linked to said left front and said left rear connectors, and said right front and said right rear connecters, respectively, a pair of identical back frames each pivotally linked to one of said arm rests, and a back soft cover attaching on said back frames.

* * * * *